US006427240B1

(12) United States Patent
Royal

(10) Patent No.: US 6,427,240 B1
(45) Date of Patent: Aug. 6, 2002

(54) CLOTHING PROTECTOR

(76) Inventor: Carlos Royal, 2600 La Costa Ave., La Costa, CA (US) 92009

( * ) Notice: Subject to any disclaimer, the term of this patent is extended or adjusted under 35 U.S.C. 154(b) by 0 days.

(21) Appl. No.: 10/004,907

(22) Filed: Nov. 2, 2001

(51) Int. Cl.[7] ..... A41B 13/10
(52) U.S. Cl. ..... 2/49.1; 2/49.2; 2/49.4
(58) Field of Search ..... 2/49.1, 49.2, 49.4, 2/46, 48

(56) References Cited

U.S. PATENT DOCUMENTS 2,367,383 A * 1/1945 Tiscornia ..... 2/49.2
2,440,666 A * 4/1948 Miller ..... 2/49.4
2,501,010 A * 3/1950 Seidenbaum ..... 2/49.1
2,622,246 A * 12/1952 Hufnagel ..... 2/49.1
2,760,200 A * 8/1956 Shamyer, Jr. ..... 2/49.4
4,114,199 A * 9/1978 Malan ..... 2/49.2
4,601,065 A * 7/1986 Sigl et al. ..... 2/49.2
4,660,224 A * 4/1987 Ashcraft ..... 2/48
4,924,527 A * 5/1990 Hintermeyer ..... 2/49.2
5,530,968 A * 7/1996 Crockett ..... 2/46
5,682,609 A * 11/1997 Ayo ..... 2/49.2
5,802,610 A * 9/1998 Burr ..... 2/49.4
6,334,220 B1 * 1/2002 Frye ..... 2/49.2

* cited by examiner

*Primary Examiner*—Gloria M. Hale
(74) *Attorney, Agent, or Firm*—Foley & Lardner; Bernard Kleinke

(57) ABSTRACT

A clothing protector for wearing around a user's neck for protecting a user's clothing. The clothing protector comprises a body portion adapted to cover an area of the user to be protected and a neck portion adapted to attach the clothing protector to the user. The neck portion has a neck opening for accommodating the user's neck and a cutout for placing the neck portion around the user's neck.

6 Claims, 4 Drawing Sheets

CLOTHING PROTECTOR

BACKGROUND OF THE INVENTION

1. Field of the Invention

The invention relates generally to clothing protectors. In particular, the invention relates to a disposable, one-size-fits-all, and easy-to-wear clothing protector.

2. Related Art

Clothing protectors such as bibs are commonly used for several purposes. Bibs are used in restaurants while dining, for feeding babies, as well as for medical purposes such as at dentists' offices. Thus, such clothing protectors may be required for adults as well as children. Clothing protectors, therefore, must fit a large variety of user sizes.

In order to accommodate the variety of heads and necks, bibs are often provided in several sizes. For example, a smaller size may be provided for children, and a larger size may be provided for adults. The need for different sizes increases the expense of production as well as the expense to the consumer.

Another problem with existing clothing protectors is the difficulty in placing them on a user. For example, in a dentist's office, a clothing protector is required on the patient to prevent splashing on clothing during a procedure such as dental cleaning. Traditional clothing protectors at dentists' offices often require a metal chain to be connected behind the patients neck to secure the clothing protector in place. This arrangement has several drawbacks. One drawback is the need for possible sterilization of the metal chain each time it is used, thus increasing the expense and time required for the sterilization process. Another drawback is the time required to actually install the metal chain and the clothing protector on the patient, increasing the length of time the patient must spend at the dentist's office.

BRIEF DESCRIPTION OF THE DRAWINGS

In the following, the invention will be explained in further detail with reference to the drawings, in which.

DESCRIPTION OF CERTAIN EMBODIMENTS OF THE INVENTION

Figure 1:
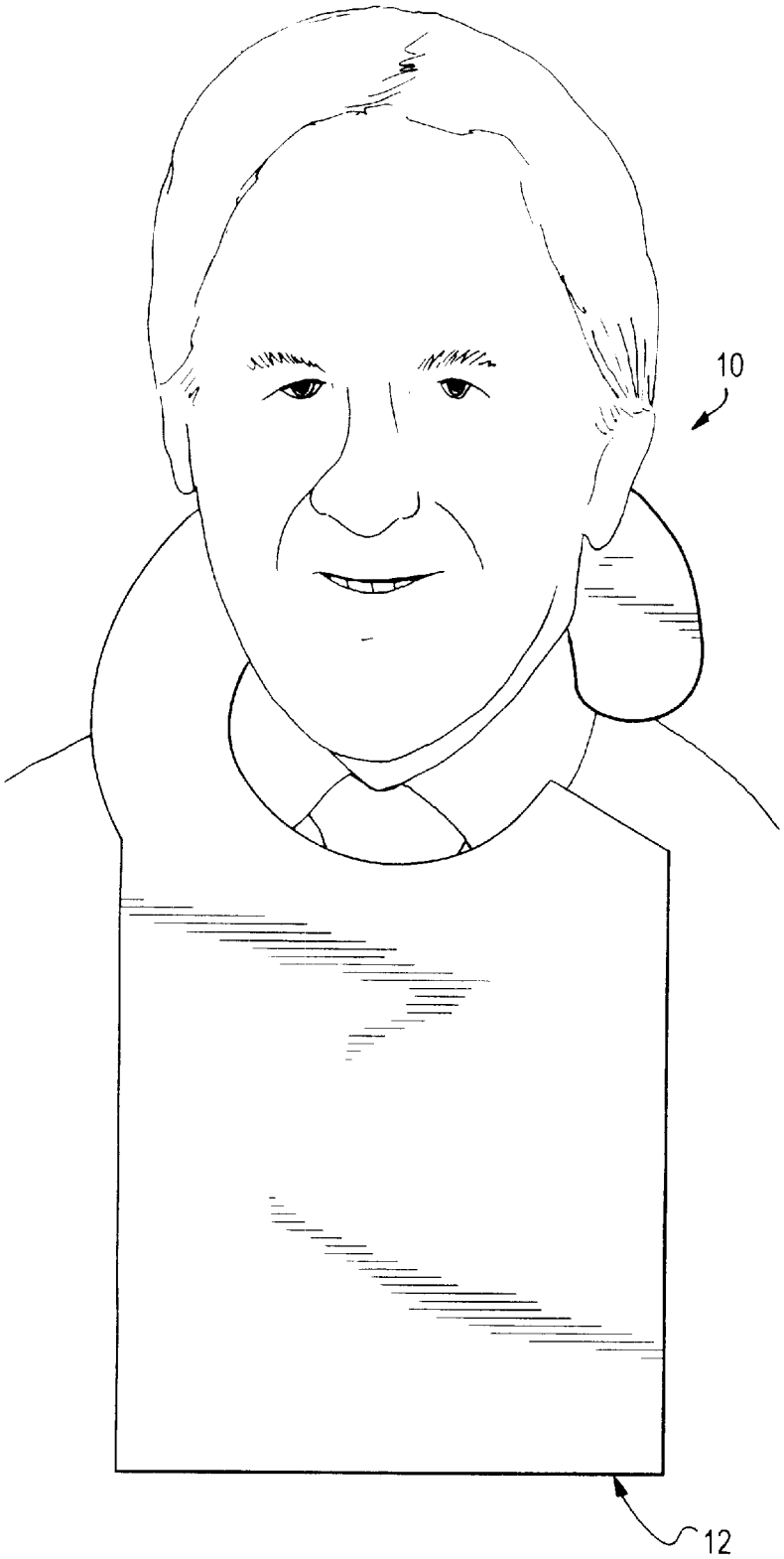
FIG. 1 is a pictorial illustration of a patient wearing a clothing protector according to one embodiment of the invention.

FIG. 1 illustrates an embodiment of the present invention in use. A user 10 is illustrated as wearing a clothing protector 12 according to the present invention. The user 10 may be an adult or a child. Further, the user 10 may be a diner at a restaurant, a patient in a dentists office, or a baby in a high chair. The clothing protector 12 covers at least the user's chest area, but may be made larger to cover a broader area. The broader area may include the shoulders, the arms and the lap area.

Figure 2:
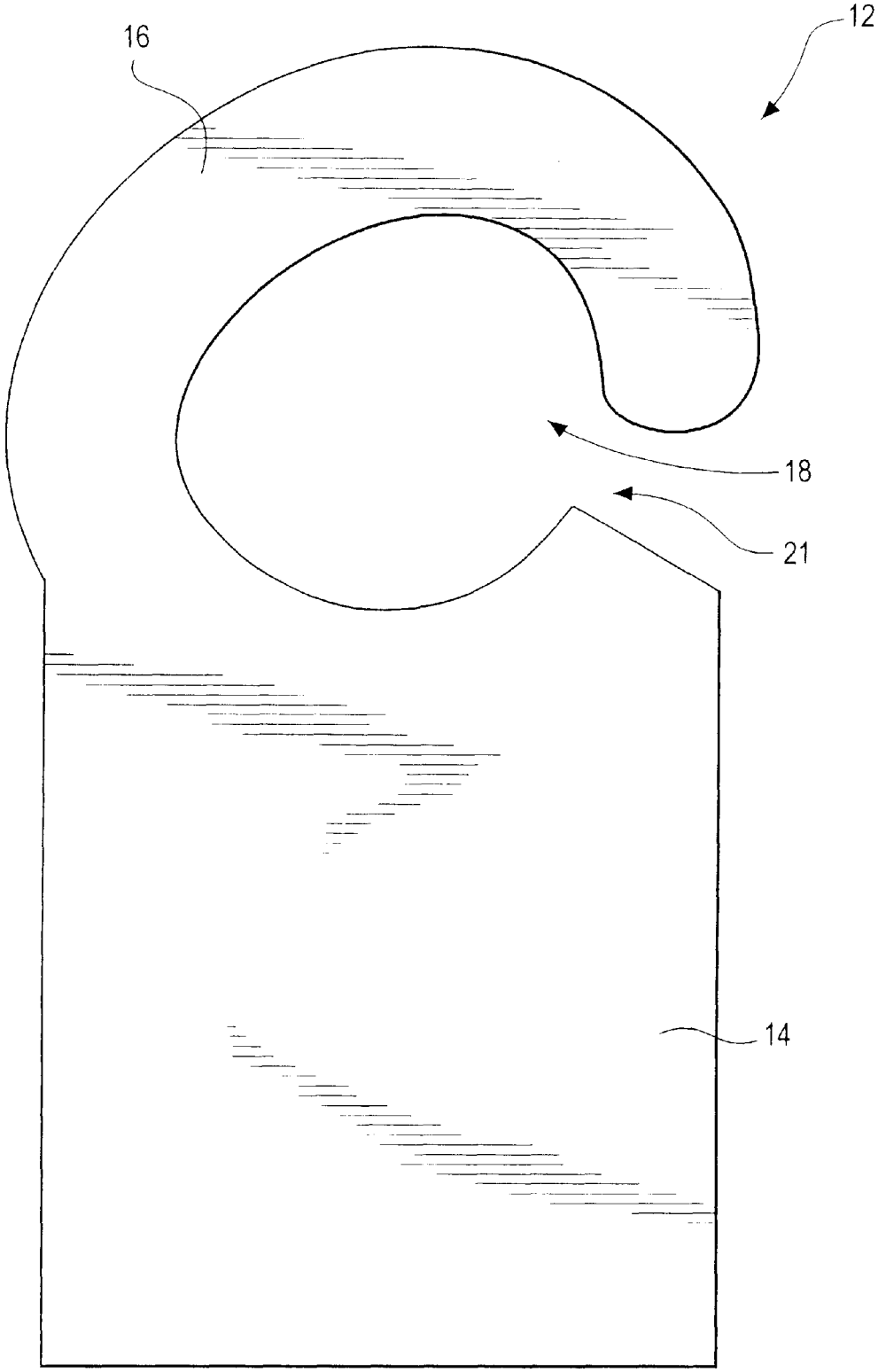
FIG. 2 is a pictorial illustration of one embodiment of a clothing protector according to the invention.

FIG. 2 illustrates in greater detail a clothing protector according to one embodiment of the invention. The clothing protector 12 comprises a body portion 14 and a neck portion 16. As noted above, the body portion 14 may be sized to cover a user's chest area or may be sized to cover a broader area including the user's shoulders, arms and lap.

The neck portion 16 is of a generally circular configuration. The neck portion 16 has a large, generally circular neck opening 18 in its center. The neck opening 18 is sized to accommodate the neck of any human user. Thus, the neck opening 18 may be large enough to accommodate a child or an adult. The generally circular neck portion 16 is provided with a cutout 21. The cutout 21 allows a user to quickly place the clothing protector 12 around his/her neck.

The clothing protector 12 may be made of any suitable material. In one embodiment, the clothing protector 12 is made of paper, thus providing a low-cost, disposable clothing protector. In another embodiment, the clothing protector is made of a two-ply material. The two plies may be a paper front with a plastic backing to provide a clothing protector with some absorbent characteristics while being somewhat waterproof on the clothing side. The neck portion 12 may be made of a stiffer material such as cardboard to increase the ease of placing it on a user.

Figure 3:
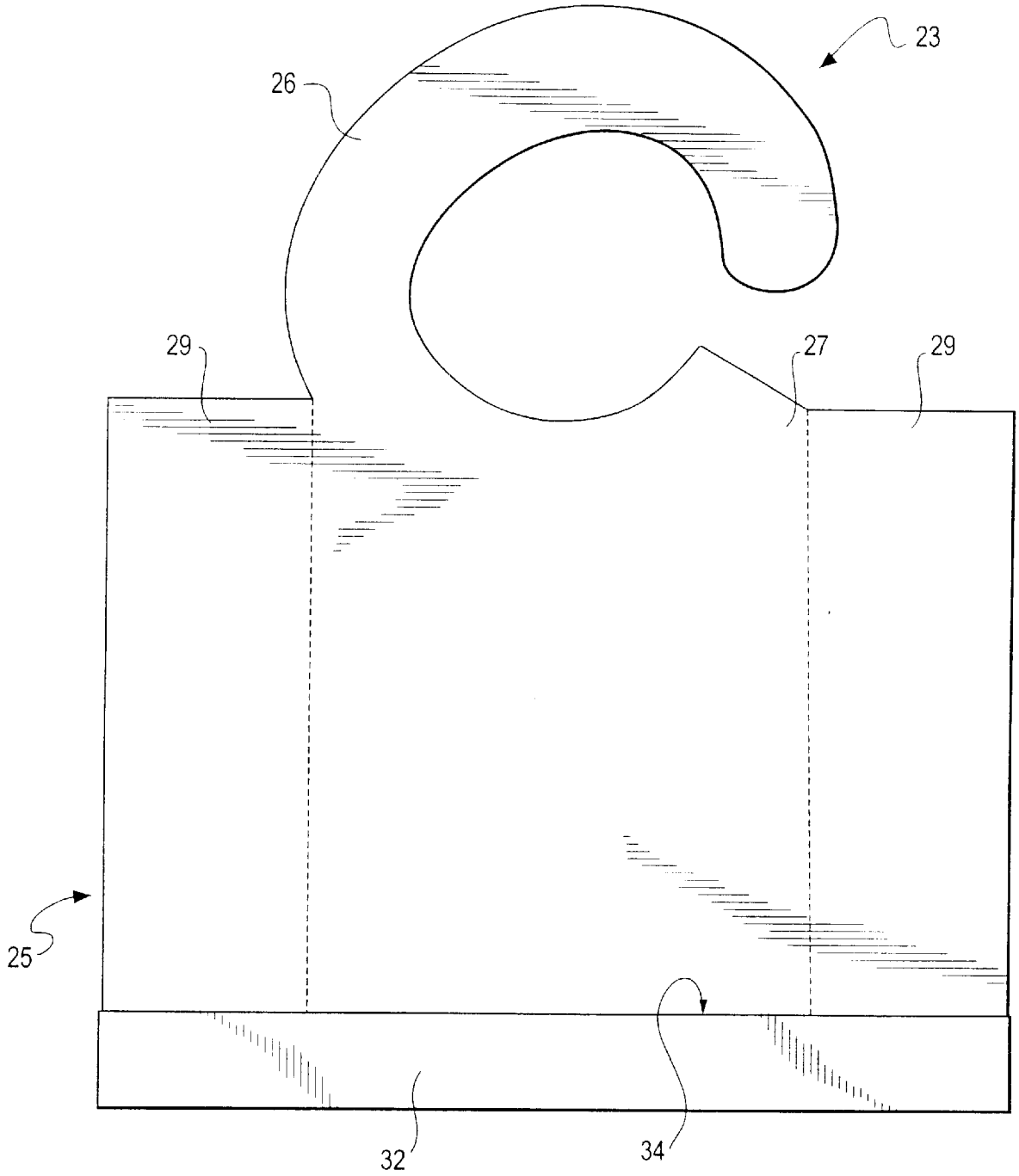
FIG. 3 is a pictorial illustration of a clothing protector according to a second embodiment of the invention.

FIG. 3 illustrates a clothing protector according to another embodiment of the invention. The clothing protector 23 has a body portion 25 and a neck portion 26 similar to those illustrated in FIG. 2. In this embodiment, the body portion 25 is provided with a central portion 27 and fold-out side portions 29. The side portions 29 provide extension of the body portion 25 in order to provide increased protection for the user. The size of the extensions of the side portions 29 may be particularly suited for a specific use. For example, certain uses may require the side portions 29 to extend well over the arms and shoulders of the user.

The clothing protector 23 may also be provided with a flap 32 at the bottom of the body portion 25. The flap 32 forms a pocket 34 along the length of the bottom edge of the body portion 25. The pocket 34 may be formed by either gluing or stitching the flap to the side edges of the bottom portion of the body portion 25. It may also be formed with side gussets to enable the flap to bow or bulge slightly outwardly to help collect falling crumbs or other particles. Thus, a pocket for catching crumbs or other residue may be provided at a relatively low cost.

Figure 4:
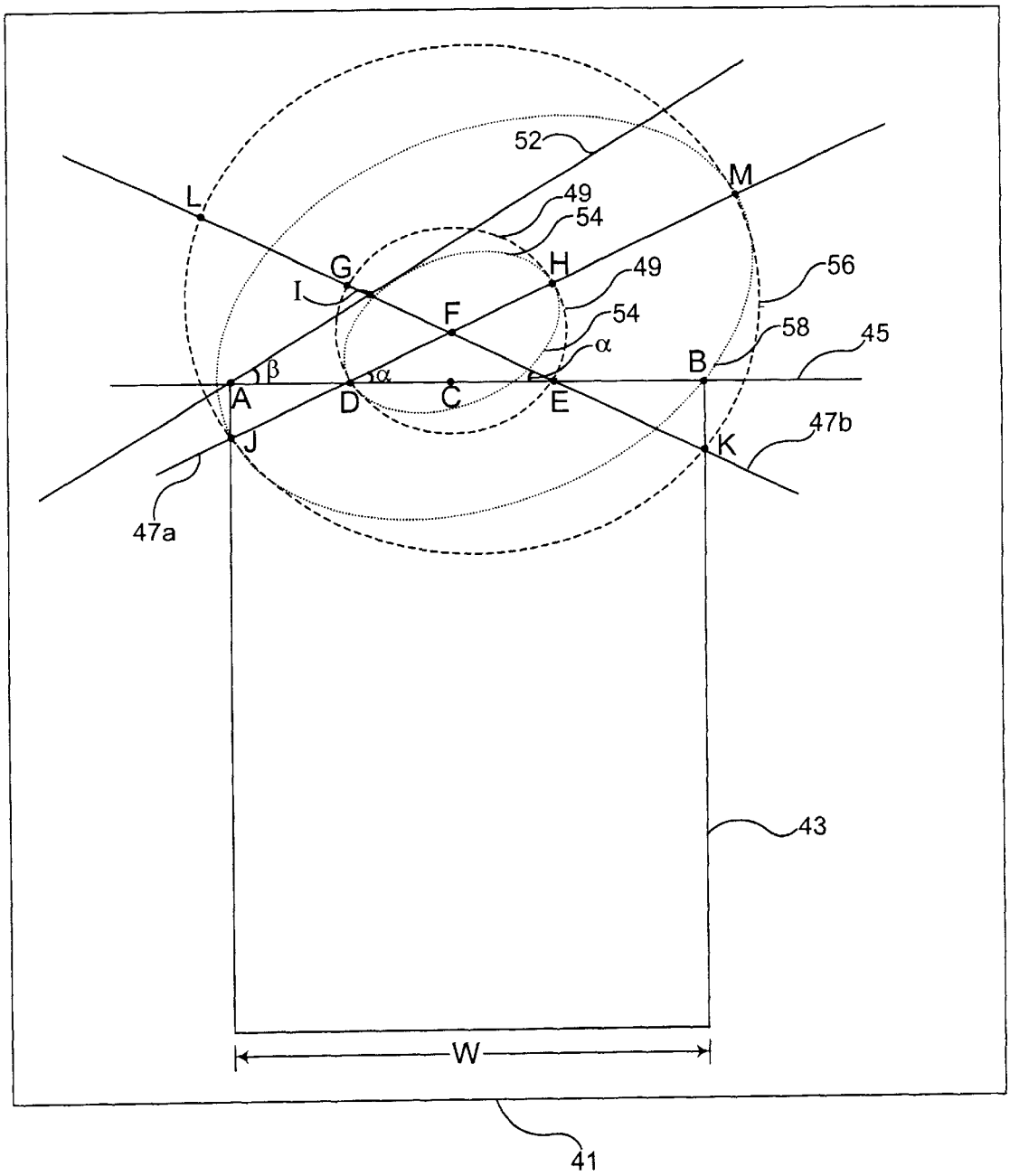
FIG. 4 is a pictorial illustration of a method of forming a clothing protector according to an embodiment of the invention.

FIG. 4 illustrates a method of forming a body protector according to an embodiment of the invention. A protector template 41 is provided from which a body protector may be formed. The template 41 may be formed of any material appropriate for a body protector. A body portion 43 is defined having a width W according to the desired dimensions of the body protector. A neck portion is formed at the top of the body portion 43 according to the following procedure. A first line 45 is constructed near the top of the body portion 43 along the width of the body portion 43. Where the first line 45 intersects the sides of the body portion 43, points A and B are defined. The segment AB has a center C. Points D and E define a segment DE centered about point C and defining the width of a desired neck opening.

Second and third lines 47*a*, 47*b* are drawn through points D and E, respectively, at a first angle $\alpha$ with respect to the first line 45. In one embodiment, $\alpha$ is 30 degrees. Point F is defined at the intersection of the second and third lines 47*a*, 47*b*. An inner circle 49 is drawn with its center at point F and a radius equal to segment EF. Points G and H are defined at the intersection of the inner circle 49 and the second and third lines 47*a*, 47*b*.

A fourth line 52 is drawn through point A at a second angle $\beta$ with respect to the first line 45. In one embodiment, β is 45 degrees. A point I is defined at the intersection of the fourth line 52 and the third line 47*b*. An inner ellipse 54 with its center at point F is drawn through points D and H, and tangent to the fourth line at point I.

Points J and K are defined at the intersection of the second and third lines 47*a*, 47*b* with the sides of the body portion 43. An outer circle 56 is drawn with its center at point F and a radius equal to segment FK. Points L and M are defined at the intersection of the outer circle 56 and the second and third lines 47*a*, 47*b*. An outer ellipse 58 with its center at point F is drawn through points B, J and M.

Next, the template 41 may be cut along the following segments and arcs to form a body protector with a neck opening. First, a cut is made from point K on the outer circle 56 to point E on the inner circle 49. Next, a cut is made along an arc on the inner circle 49 from point E, going clockwise, to point D. Next, a cut is made along an arc on the inner ellipse 54 from point D, going clockwise, through point I to point H. The neck opening is completed by cutting along an arc on the inner circle 49 from point H to point E.

The outer edge of the neck portion is formed by first making a cut along the outer circle 56 from point K, going counter-clockwise, to point M. Next, a cut is made along an arc on the outer ellipse 58 from point M, going counter-clockwise, to point J. Finally, the segment MKEH of the neck portion may be trimmed to a rounded end for convenience and the body portion 43 may be cut from the template beginning at point J, going counter-clockwise along the outline of the body portion, to point K.

Other contemplated methods of forming the body protector may cut along different arcs or lines. For example, a simple circular neck opening may be formed by cutting along the entire circumference of the inner circle. Alternatively, a completely elliptical opening may be formed by cutting along the full perimeter of the inner ellipse.

Thus, a body protector according to the present invention provides protection to the user at a relatively low cost since only one size must be provided. The one size fits small children and larger adults equally well. Additionally, a clothing protector according to the present invention is easy to mount on a user. This may be particularly useful in a medical setting. Further, a clothing protector according to the present invention is completely disposable, not requiring any additional components that may require sterilization.

While particular embodiments of the present invention have been disclosed, it is to be understood that various different modifications and combinations are possible and are contemplated within the true spirit and scope of the appended claims. There is no intention, therefore, of limitations to the exact abstract and disclosure herein presented.

What is claimed is:

1. A method of forming a clothing protector for wearing a round a user's neck, comprising:

defining a width of a body portion;

defining a width of a neck opening;

forming an outer circle having a diameter based on said width of a body portion;

forming an outer ellipse within said outer circle;

forming an inner circle having a diameter based on said width of a neck opening;

forming an inner ellipse within said inner circle;

cutting a neck opening along portions of at least one of said inner circle and said inner ellipse; and cutting a neck portion along portions of at least one of said outer circle and said outer ellipse.

2. The method of forming a clothing protector according to claim 1, further comprising:

defining a segment DE centered along a first line, said segment having endpoints D and E, said first line being along said width of a body portion;

forming a second line through point D and a third line through point E, said second and third lines being at an angle a relative to said first line; and defining a point F at an intersection of said second line and said third line, said point F defining a center of said inner circle and said outer circle.

3. The method of forming a clothing protector according to claim 2, wherein α is 30 degrees.

4. The method of forming a clothing protector according to claim 1, further comprising:

defining a point A at an intersection of said first line with an outline of said width of a body portion;

forming a fourth line through point A at an angle β relative to said first line;

wherein said inner ellipse is tangent to said fourth line.

5. The method of forming a clothing protector according to claim 4, wherein β is 45 degrees.

6. A clothing protector for wearing around a user's neck for protecting a user's clothing, comprising:

a body portion adapted to cover an area of the user to be protected; and a neck portion adapted to attach the clothing protector to the user, said neck portion having:

a neck opening for accommodating the user's neck; and a cutout for placing the neck portion around the user's neck; and wherein said body portion comprises a pocket along a bottom edge of said body portion, said pocket being adapted to catch residue; and wherein said pocket is formed by a flap stitched to said body portion at side edges of said flap.

* * * * *

UNITED STATES PATENT AND TRADEMARK OFFICE

CERTIFICATE OF CORRECTION

PATENT NO. : 6,427,240 B1
DATED : August 6, 2002
INVENTOR(S) : Carlos Royal

It is certified that error appears in the above-identified patent and that said Letters Patent is hereby corrected as shown below:

Column 3,
Line 55, change "a round" to -- around --

Signed and Sealed this

First Day of October, 2002

*Attest:*

*Attesting Officer*

JAMES E. ROGAN
*Director of the United States Patent and Trademark Office*